United States Patent [19]

Banks

[11] Patent Number: 4,670,945

[45] Date of Patent: Jun. 9, 1987

[54] DOUBLE LOOP STRAP FASTENER WITH RELEASE TABS

[76] Inventor: Donald D. Banks, 812 Peterson St., Fort Collins, Colo. 80524

[21] Appl. No.: 761,963

[22] Filed: Aug. 2, 1985

Related U.S. Application Data

[63] Continuation-in-part of Ser. No. 344,488, Feb. 1, 1982, abandoned, and a continuation-in-part of Ser. No. 565,978, Dec. 27, 1983, abandoned.

[51] Int. Cl.[4] ..... A44B 11/12

[52] U.S. Cl. ..... 24/170; 24/193; 24/197

[58] Field of Search ..... 2/322, 421; 24/168, 24/191, 170, 193, 197, 30.5 R, 519

[56] References Cited

U.S. PATENT DOCUMENTS

| | | | |
|---|---|---|---|
| 300,924 | 6/1884 | Walters et al. | 24/519 |
| 491,123 | 2/1893 | McClure | 24/193 |
| 1,021,088 | 3/1912 | Brown | 24/170 |
| 1,274,030 | 7/1918 | France | 24/197 |
| 1,697,833 | 1/1929 | Lane | 24/197 |
| 2,079,457 | 5/1937 | Laurisin | 24/170 X |
| 2,853,757 | 9/1958 | Rave | 24/197 |
| 3,205,549 | 9/1965 | Keech | 24/30.5 R X |
| 3,277,543 | 10/1966 | Gaylord | 24/193 |
| 3,335,468 | 8/1967 | Harley | 24/193 X |

FOREIGN PATENT DOCUMENTS

| | | | |
|---|---|---|---|
| 12376 | of 1892 | United Kingdom | 24/193 |
| 549625 | 11/1942 | United Kingdom | 24/193 |
| 727813 | 4/1955 | United Kingdom | 24/193 |

*Primary Examiner*—Peter A. Aschenbrenner
*Assistant Examiner*—James R. Brittain
*Attorney, Agent, or Firm*—John E. Reilly

[57] ABSTRACT

A strap fastener of the type having a pair of loop members with means pivotally connecting one end of the loop members together is disclosed. Each loop member has opposite sides extending away from its connected end and terminating in a free closed end portion with the closed end portions being free to pivot toward or away from the other connected end so that a strap can be threaded outwardly through the loops, doubled over the closed end of the outer loop and returned through the inner loop.

7 Claims, 11 Drawing Figures

DOUBLE LOOP STRAP FASTENER WITH RELEASE TABS

This application is a continuation-in-part of Ser. No. 344,488, filed Feb. 1, 1982, now abandoned, and Ser. No. 565,978, filed Dec. 27, 1983, now abandoned.

This invention relates to releasable strap-type fasteners, and more particularly relates to a novel and improved quick-releasing fastener for chinstraps, belts, webbing and similar types of flexible or fabric members.

BACKGROUND AND FIELD OF THE INVENTION

The type of clasp commonly known as the "D-ring" comprises two rings secured to a common or looped end of a strap and another strap is releasably fastened to the rings by threading the other strap through both rings, then doubling back through one ring so that the other strap is frictionally retained between the rings. This device has seen many applications, adaptations and improvements since its introduction in the late 1800's. An early approach to a fastener of this type is described in U.S. Pat. No. 395,965 to Ferris, which discloses a clasp comprising two wire loops which hold the tape of a stocking supporter threaded therethrough. U.S. Pat. No. 1,393,881 to Burg describes a belt buckle of similar operation wherein the wire loops have a rectangular, rather than rounded configuration. Other forms and uses for the basic D-ring type fastener are further illustrated in U.S. Pat. Nos. 655,882 to Maxwell and 1,484,680 to Stoddard et al.

Presently, the D-ring is commonly used as an adjustable clasp for straps, belts, webbing and the like. For example, U.S. Pat. No. 4,044,400 to Lewicki et al discloses its use as a part of a helmet retention system. When used for this purpose, however, the standard D-ring is in many ways inconvenient and difficult to manipulate both in threading or fastening the strap; and once threaded and tightened, the rings cannot be easily loosened or expanded without the use of both hands. The procedure is further complicated if the hands or strap is wet, or if the cyclist is wearing gloves, as is often the case. Moreover, in the event of accident or emergency, it may be necessary for the wearer or rescuer to remove the helmet quickly. For instance, in the fastener of Lewicki et al, which is provided with a pull-tab for easier grasping, quick and complete release of the strap cannot be effected with one hand without considerably dexterity on the part of the wearer. Another problem associated with fasteners of the loop or D-ring type is the difficulty of applying sufficient leverage to release the strap once tightened in place, since the releasing force must be applied at or adjacent to the fastening of the strap to the ring.

SUMMARY OF INVENTION

It is therefore an object of the present invention to provide for a novel and improved fastener for straps and the like which facilitate quick and reliable fastening, adjustment and release of one strap with respect to the other.

It is another object of the present invention to provide for a novel and improved D-ring type clasp for straps and the like which may be easily and quickly adjusted or released with one hand.

It is an additional object of the present invention to provide for fastener rings for a strap to enable adjustment or release of the strap when one's dexterity is limited by gloves, cold, dampness or injury.

It is yet another object of the present invention to provide a fastener for helmets and the like which allows the wearer or another person to rapidly and safely release the fastener and remove the helmet in case of accident or other emergency; and further wherein the fastener may be economically manufactured and either stamped or molded out of metal or rigid plastic materials.

It is a still further object of the present invention to provide in a fastener of the D-ring type for substantially increased leverage in releasing the strap from engagement with the D-rings; and further wherein the strap can be readily connected to and released from the D-rings as desired.

The fastener of the present invention is of the type having a pair of loop members or frames with means pivotally connecting one end of the loop members together. Each loop member has opposite sides extending away from its connected end to terminate in a free leverage end portion, each leverage end portion being free to pivot or swivel toward and away from the other leverage end so that a strap member can be threaded outwardly through the loops, doubled over the outer loop and returned through the inner loop. In this setting, the present invention makes provision for a novel form of release tab arrangement including a pair of release tabs extending laterally and downwardly away from one loop member near the forward or leverage end thereof, and a second release tab projecting forwardly from the leverage end of the other loop member. In this way, the release tabs can be easily grasped by the fingers of one hand to apply maximum leverage in separating the loop members and readily releasing the strap from its compressed condition between the loops.

More specifically, one form of invention embodies two frames or loops secured to a looped end of a chin strap for helmets and the like. The inner loop features a tab projecting from its forward leverage end; and a portion of each side of the outer loop has oppositely directed tabs extending laterally from opposite sides of the loop. The second, longer helmet strap is threaded through both loops, passed around an intermediate crossbar in the outer loop, then doubled back under the inner loop, as for ordinary fasteners of this type. Quick release is effected by pressing on the forward tab with the index finger to move the inner loop inwardly, while the laterally projecting tabs can be easily grasped and pulled outwardly with the thumb and second finger thereby causing the outer loop to be pulled simultaneously outwardly and away from the inner loop. In this manner, tension on the strap is immediately reduced, and by continuing to pull outwardly the strap is released from the loops. This is particularly advantageous when the device is used on a chinstrap, and the operator cannot see the fastener in releasing it. Conversely, the strap may be threaded more quickly, as the tabs allow the wearer to hold the loops apart with one hand while re-inserting the strap through the loops. Preferably, the crossbar is located as close as possible to the connecting end to establish maximum leverage in release. Provision of a crossbar also facilitates front or side loading of the strap.

In an alternate embodiment of the invention, the release tab arrangement includes a pair of tabs formed by bending or curving a portion of each side of one loop member, preferably the outer loop member, laterally away from the loop and vertically in a direction toward the other loop member; and the inner loop is provided with a release tab projecting from the forward closed end of the loop and formed integrally therewith. The strap is threaded in the manner described above with reference to the first embodiment and release of the strap is effected by pressing on the forward tab with the index finger to move the inner loop inwardly while simultaneously grasping the side tabs and pulling outwardly with the thumb and second finger thereby causing the outer loop to be pulled outwardly and away from the inner loop. The laterally projecting configuration of the side tabs allows them to be grasped readily, while the angulation of the tabs toward the inner loop causes the outer loop to overlap the sides of the inner loop thereby keeping the loops in proper alignment and preventing the strap from slipping prior to release of the fastener.

In a third embodiment of the present invention, the opposite sides of the outer loop are provided with right angle tabs overlapping opposite sides of the inner loop. The side tabs are tapered from the forward end of the outer loop in a direction toward the opposite connecting end. The inner loop features a forwardly projecting raised end tab which is vertically offset so as to be elevated with respect to the forward or free end of the loop. This arrangement is particularly advantageous in that when the strap is threaded and tightened in the above-described manner the outer loop is drawn inwardly toward the inner loop until the side tabs overlap the side edges of the inner loop. Thus, the tabs are operative to maintain the outer and inner loops in proper aligned relation so as to prevent inadvertent loosening of the strap. The forward tab being elevated with respect to the inner or underlying loop is in a position to be easily grasped with even limited dexterity and, in combination with those portions of the side tabs near the closed end, afford superior leverage in releasing the fastener.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
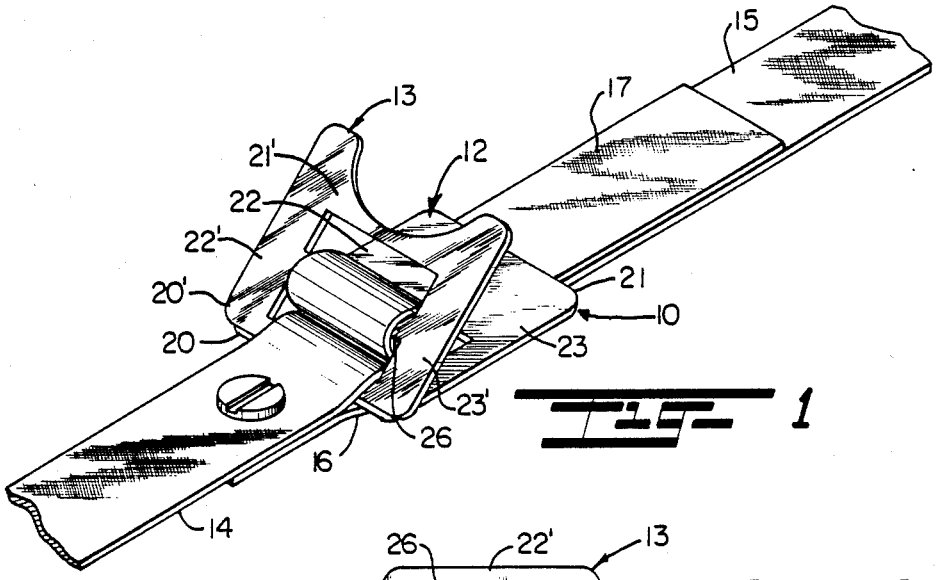
FIG. 1 is a somewhat perspective view of a preferred form of fastener in accordance with the present invention.

Referring in more detail to the drawings, there is shown in FIGS. 1 to 4 a preferred form of fastener 10 which is broadly comprised of a pair of loop or frame members 12 and 13 adapted for releasably securing together a pair of strap portions 14 and 15. For the purpose of illustration and not limitation, the strap portions 14, 15 may, for example, be of the type employed on a chin strap for a helmet, each strap portion depending downwardly from opposite sides or ear sections of the helmet, not shown, and one of the strap portions 14 terminating in a looped end 16 and the other strap portion 15 terminating in a free end 17.

Considering in more detail the construction and arrangement of a preferred form of fastener, the loop or frame members 12 and 13 each are of somewhat elongated, generally rectangular configuration and of substantially corresponding size. Accordingly, the inner loop or frame member has opposite ends 20 and 21, respectively, and opposite sides 22 and 23, respectively. The outer loop or frame member has opposite ends 20' and 21', and opposite sides 22' and 23', respectively. The ends 20, 20' serve as connecting ends which are permanently secured within the looped end 16 of the strap portion 14 so that the loops 12 and 13 are free to swivel or pivot about the looped end 16 toward and away from one another. In this relation, the looped end 16 preferably defines an opening which is somewhat oversized with respect to the combined thickness of the ends 20, 20' so that the loop members 12 and 13 are not only free to pivot with respect to one another, but are further capable of shifting or moving in a lengthwise direction relative to one another to facilitate connection and release of the strap 15 in a manner to be described. Preferably, the rivet 16' or other loop fastening means is positioned so as to allow longitudinal movement of the loop members over a distance on the order of 1/16" to ⅛" within the looped end 16. In accordance with conventional practice, each loop member 12 and 13 is preferably composed of a rigid metal or plastic of generally rectangular cross-section and dimensioned to be of a width sufficient to more than accommodate the width of the straps 14 and 15 and of a length to permit free movement of the free end 17 of the strap 15 through the rings in releasably securing the straps together.

A particular feature of the present invention resides in the disposition and arrangement of release tabs on the loop members 12 and 13. Here, the loop member 12 is formed at its forward closed or leverage end 21 with a broad flat surface portion which defines a forwardly projecting release tab; and opposite sides 22', 23' of the loop 13 define a pair of release tabs of broad flat configuration which project beyond opposite sides 22', 23' of the loop member. In the preferred form, the side release tabs as well as the forward release tab are formed as an integral part of the loops 12 and 13. Each release tab is composed of the same material as that of the loop member itself and further may also be of generally circular cross-section if desired. The forward release tab is exposed by forming a concave relief area or recess 25 in the forward end 21' of loop member 13; and the side release tabs extend for the greater length of opposite sides 22' and 23' so that those portions adjacent the forward end can be grasped to apply maximum leverage to the loop member 13 in releasing the free end 17 of the strap.

In practice, when the strap 15 is to be releasably secured to the loop members, its free end is passed outwardly through the central opening in the loops from beneath the inner loop member 12, then is doubled back over intermediate crossbar 26 of the outer loop member 13, then is returned back through and beneath the closed end 21 of the inner loop, as best seen from FIG. 1. The crossbar 26 is located as close to the connecting end 20' as possible while leaving sufficient space for threading of the strap end 17. In this way, a moment arm is established when pressure is applied to the leverage ends of the tabs as described to facilitate release of the strap. It will be noted that once secured in the manner described, the free end 17 may be adjusted to the desired tautness; the greater the pull exerted on the free end 17, the greater the pressure exerted by the outer loop 13 against the inner loop 12 so as to tightly compress the free end 17 against the rest of the strap 15. Of course, the slight shifting afforded by the oversized, looped end 16 as a preliminary to threading of the strap through the loop members will afford some give between the loop members as the free end 17 is tightened. Once the free end 17 is released, however, the tendency of the outer loop 13 is to be advanced forwardly toward the closed end 21 of the inner loop. At the same time, the inner loop and inner surface of the strap 15 will be pressed snugly against the skin or article of clothing so as to normally resist any tendency of the free end 17 to be released.

Figure 2A:
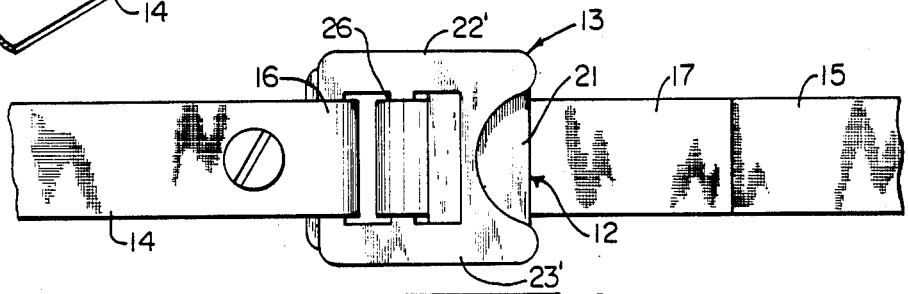
FIG. 2A is a plan view of the fastener illustrated in FIG. 1.

As a frame of reference, the loop member 12 is hereinafter referred to as the inner loop member which, for example, in use as a chin strap would rest against the chin when in the fastened position, and loop member 13 is referred to as the outer loop member. Further, as observed from FIGS. 1, 2A and 2B, when pressure is applied to the release tabs the loops are advanced or pivoted with respect to one another from a position as illustrated in FIG. 2A, to the open or released position shown in FIG. 1. Specifically, the release tabs are so positioned and arranged adjacent to one another as to facilitate grasping of both loop members 12 and 13 with one hand to effect the fastening and release operation. Specifically, the forefinger may be pressed in a downward direction against the release tab 26, and the thumb and middle fingers simultaneously pressed or engaged with the side release tabs 27 and 28 to exert a pressure in the upward direction.

In order to release the strap 15 from the loop members, the release tabs are grasped with one hand and pressed in opposite directions as described causing the loops 12 and 13 to be pivoted away from one another and the outer loop 13 to retract and slide in a lengthwise direction away from the closed end 21 of the inner loop 12 as the connecting end 20' pivots about the lower connecting end 20. Simultaneously as the loop members are spread apart, they may also be drawn away from the skin so that the free end of the strap 17 is free to unthread itself by returning back through the openings in the loops. It will be apparent that any degree of adjustment either in tightening or loosening the strap may be performed by varying the amount of pressure and outward pull by the hand on the loop members.

It is to be understood that the fastener of the present invention is conformable for use in various applications other than as a helmet or chin strap. However, it is believed that its use as a chin strap best exemplifies the features of the present invention in terms of facilitating both the fastening and release of the strap portion 15 with respect to the loops 12 and 13. Moreover, the loops may be grasped in various ways to facilitate either tightening, adjustment or release of the strap through the medium of the release tabs and their disposition on the loops. In this regard, the broad flat configuration of the release tabs will avoid any tendency of the loops to dig into the skin or other article of clothing. It should be further apparent that the particular location of the tabs may be reversed; i.e., the forward release tab may be positioned on the outer loop 13, while the side release tabs may be positioned on the inner loop 12 in which event the direction of pressure would be reversed on the respective release tabs. It is preferred, however, to mount the forward release tab as shown with the side release tabs readily accessible for grasping between the thumb and finger so that pressure may be uniformly exerted in drawing the loop 13 outwardly away from the inner loop 12. Still further, the configuration of the loops may be modified for specific applications and for example, as opposed to open flat frame members, may be either completely circular or D-shaped.

Figure 2B:
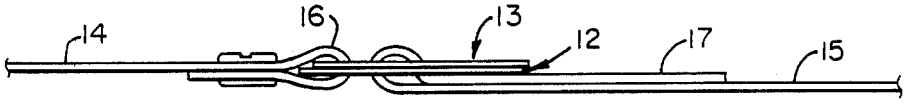
FIG. 2B is a front view in elevation of the form shown in FIG. 2A.
Figure 3:
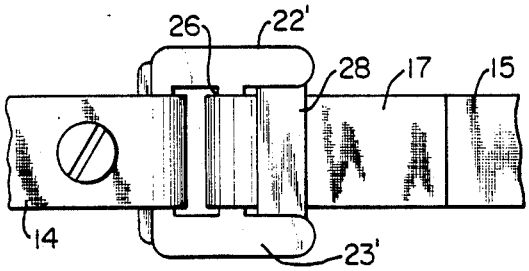
FIG. 3 is a plan view of a modified form of invention.

FIG. 3 illustrates a modified form of invention in which corresponding elements to those of FIGS. 1, 2A and 2B are enumerated with like numerals. As noted, the inner loop member 12 is identical in all respects to that of FIG. 1 but has a closed or forward end 28 which is narrower or of lesser width than the closed end 21. In turn, the outer loop 13 is identical in all respects to that of FIGS. 1, 2A and 2B but omits the intermediate portion of the free end 21' between the side release tabs 22' and 23'. This form is particularly useful in applications where front loading of the strap 15 is desired or, in other words, permits the free end 17 of strap 15 to be conveniently grasped and threaded through the inner loop member after passing around the crossbar 26 by reaching directly between the side release tabs.

Figure 4:
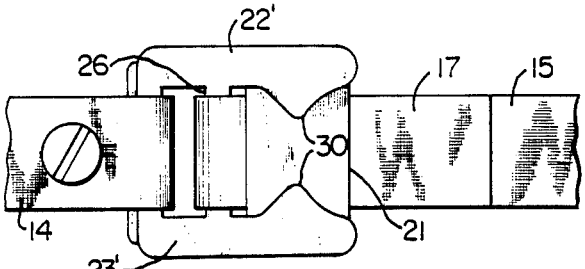
FIG. 4 is a plan view of another modified form of invention.

FIG. 4 introduces a modification to the form illustrated in FIG. 3 by providing laterally inwardly directing ledges or shelves 30 on each of the side release tabs 22', 23' so as to afford a broader contact area between the side release tabs and the forward release tab or end 21 of the inner loop member but enables front loading of the strap as described in FIG. 3.

Figure 5:
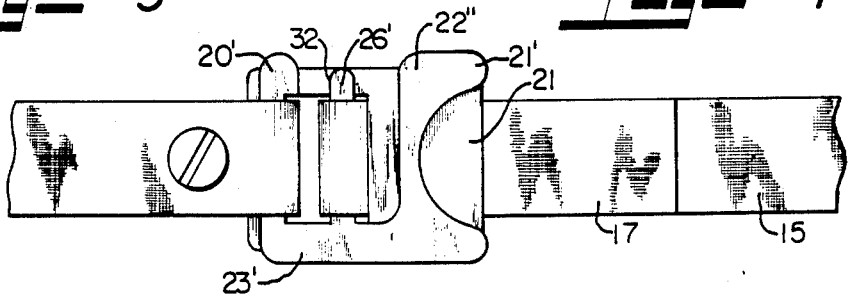
FIG. 5 is a plan view of an alternate embodiment of fastener in accordance with the present invention.

FIG. 5 illustrates still another modified form of invention in which the inner loop 12 corresponds to that of FIGS. 1, 2A and 2B; however, the outer loop member has a portion of one side 22' removed or recessed to define an entrance space for the strap between forward end 21' and connecting end 20'. In this way, the intermediate crossbar 26' projects away from one side 23' and terminates in a rounded free end 32 spaced between the forward end 21' and connecting end 20'. This will permit side loading of the free end 17 of the strap 15 by first looping the end 17 and advancing it laterally over the crossbar 26' until the crossbar 26' projects through the opposite side of the loop as illustrated in FIG. 5. The free end 17 is then threaded underneath the forward end 21 of the inner loop member in the same manner as described with reference to FIG. 1. In this form, it will be noted that the forward end 20' includes a side release portion 22'' which cooperates with the opposite side release portion 23' as in the earlier forms described to facilitate grasping and release of the loops.

With respect to the forms described in FIGS. 1 to 5, it will be noted that the intermediate crossbar functions to move the load as close to the pivot or connecting end as possible and increase the leverage which can be applied to the release tabs and free ends of the loops. The pivoting or connecting end 20' preferably has a width less than that of the lower connecting end 20 so that its rearward edge rests on the surface of the lower end 20 and is freely pivotal as the strap is released. Also, the crossbar 26 is spaced from the end 20' to leave sufficient space for threading of the strap around the crossbar. The rearward edge of the leverage end 21 is spaced far enough in front of the crossbar 26 as to permit threading of the free end 17 of the strap when the bars are spaced apart and to introduce a slight rearward bend in the strap when the strap is tightened in place.

DESCRIPTION OF ALTERNATE EMBODIMENTS

Figure 6:
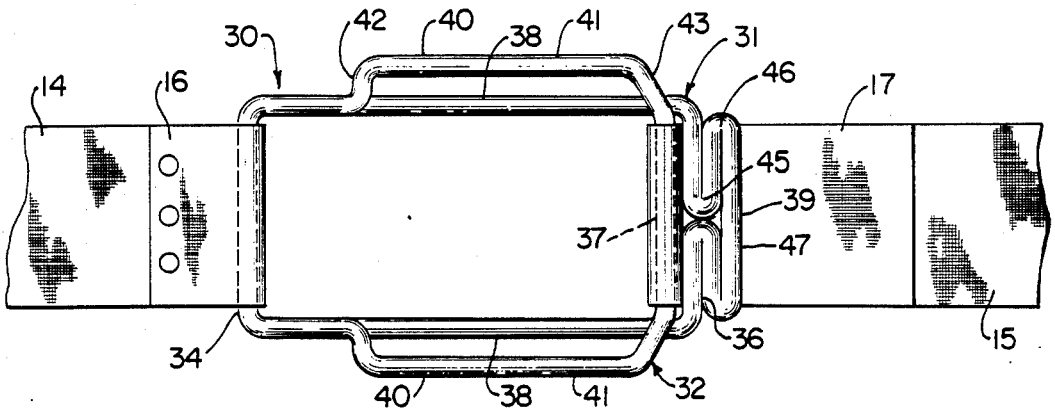
FIG. 6 is a plan view of another alternate embodiment of the present invention.
Figure 7:
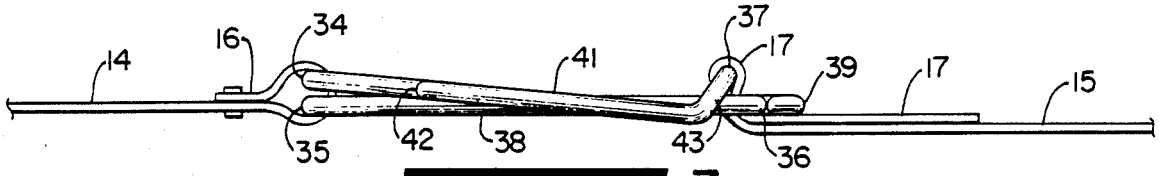
FIG. 7 is a side view in elevation of the fastener illustrated in FIG. 6.

FIGS. 6 and 7 illustrate an alternate embodiment of the fastener of the present invention, with like parts being correspondingly enumerated with reference to the preferred embodiment. The modified fastener 30 similarly comprises a pair of elongated frame members 31, 32. As in the preferred embodiment, one end 34 of the outer frame 32 and end 35 of the inner frame 31 are enclosed within the looped end 16 of the strap 14 whereby to pivotally connect the frames 31, 32 together while leaving their respective opposite closed ends 36, 37 free for movement toward and away from each other. As in the preferred embodiment, the looped end 16 is slightly enlarged to permit longitudinal sliding or shifting of the frames. The outer frame 32 is provided with release tabs on opposite sides 40 thereof, which are formed by bending portions of the sides 40 outwardly away from the inner frame 31 as at 42, followed by bending the side portions at an angle downwardly toward the inner frame 31 thereby forming offset side tabs 41. The tabs are then bent back in an upward direction forming angled portions 43 which join the closed end 37 of the frame 32. An end tab 39 is formed at the forward end 36 of the inner frame 31. The sides of the frame are pinched or crimped together as at 45 to define forward frame end 36, oppositely directed reverse curved portions 46 and a tab end segment 47.

As shown in FIG. 7, the arrangement of offset side tabs on the outer frame 32 is such that when the fastener is in the closed or fastened position, the tabs 41 extend below the sides 38 of the inner frame 31 on either side thereof. Therefore, when the strap is threaded and tightened as described above with reference to the preferred embodiments, the tightening force exerted on the closed end 37 of the outer frame 32 tends to cause the outer frame to slide forwardly so that the end 37 bears against the forward end 36 of the inner frame so as to press or sandwich the strap therebetween. This arrangement maintains the frames and straps in proper alignment and produces greater frictional engagement with the strap so as to prevent the strap from slipping or unwinding until the release tabs are actuated. An additional advantage of this embodiment is that the offset side tabs are more easily grasped so as to provide superior leverage when releasing or adjusting the strap. Release of the fastener is effected in substantially the same manner as described above with reference to the preferred embodiment, the side tabs being grasped to effect longitudinal retraction of the outer frame 32 with respect to inner frames 31 thereby relieving the pressure exerted on the strap by closed ends 36, 37 of the frames.

Figure 8:
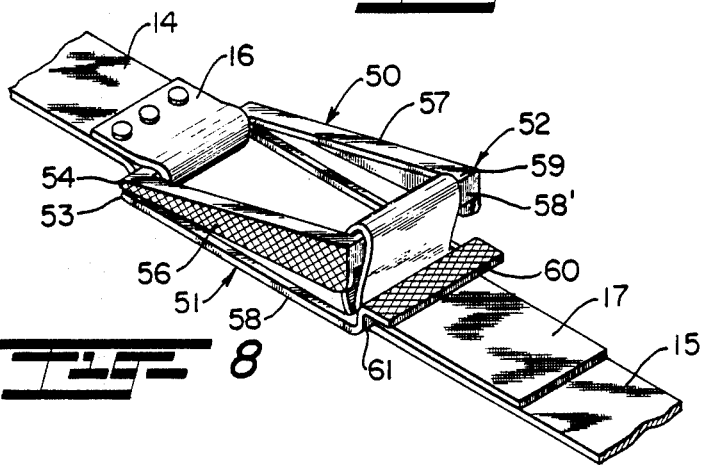
FIG. 8 is another alternate embodiment of fastener in accordance with the present invention.
Figure 9:
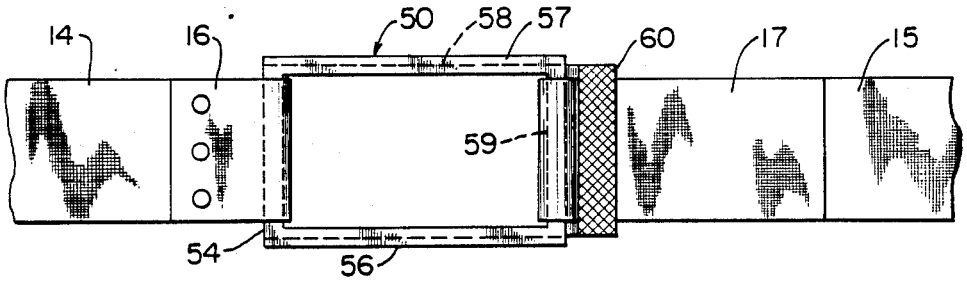
FIG. 9 is a plan view of the fastener illustrated in FIG. 8.
Figure 10:
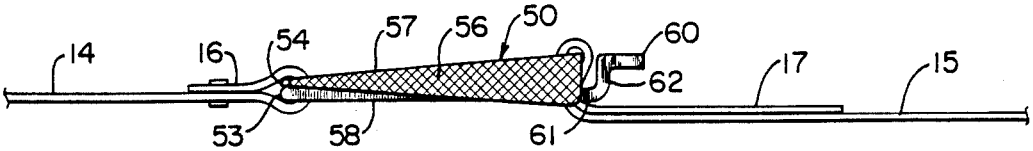
FIG. 10 is a side view in elevation of the fastener illustrated in FIG. 8.

The embodiment 50 of the present invention shown in FIGS. 8 to 10 similarly comprises superimposed inner and outer frames 51, 52 pivotally connected together by enclosing ends 53, 54 within a loop 16 formed in the strap 14. In this embodiment, it is preferable that the frame members be rectangular in cross-section rather than circular as in the previous embodiments. The frames may be fabricated from metal, plastic or other suitable material. The release tab means includes a pair of tabs 56 extending at approximate right angles from the sides 57 of the outer frame 52 in a direction toward, but in overlapping relation to, the inner frame 51. The side tabs 56 are in the form of narrow plates extending the greater length of sides 57 of the frame 52 and are tapered along their length from the free forward end 59 of the frame 52 to the pivotally connected end 54 thereof so that the wider end extends inwardly beyond the inner frame. In order to facilitate grasping and manipulation, the side tabs 56 are provided with a cross-hatched or knurled outer surface and a spacer plate 58 is disposed across the free end 59 to limit the inward movement of the outer frame 52 with respect to the inner frame 51.

The inner frame 51 is provided with a forwardly projecting raised tab 60 which is disposed in spaced parallel relation above the forward free end 61 of the frame 51. A portion of the forward end 61 is bent or curved upwardly to form a right angle end wall 62 which in turn is bent in an outward direction to form the right angle projecting tab 60 in spaced parallel relation to the inner frame. Like the side tabs 56, this end tab 60 is provided with a knurled contact surface. As in the previous embodiments, the end 17 of strap 15 is threaded through frames 51 and 52, then is looped in a reverse direction over the forward end 64 of the outer frame 52 and under the forward end 61 of the inner frame 51. The fastener 50 is released by pressing downwardly against the elevated end tab 60 to cause the inner ring 51 to move inwardly. By grasping the wider ends of the side tabs 56 on either side of the outer frame 52, greater leverage can be obtained in forcing or pulling the frame 52 outwardly and away from the inner frame 51. Since the end tab 60 is raised with respect to the inner frame 51 in the strap 15, the tab 60 is more accessible to manipulation and, together with the wider ends of the tabs 56, affords greater leverage even when the operator's dexterity is limited; hence, the frames 51, 52 can be spread with greater speed and efficiency to effect quick release of the strap.

Referring to FIG. 10, it will be seen that when the fastener is in the closed fastened position, the outer frame 52 is pulled inwardly toward the inner frame 51 so that the side tabs 56 are positioned immediately adjacent the outer edge of sides 58 on the inner frame and the forward widened portions of the tab 56 project a short distance beyond the sides 58 of the inner frame. As described above with reference to the first alternate embodiment, the angled orientation of the side tabs with respect to the inner frame 51 maintains proper alignment of the frames and strap by preventing lateral shifting of the frames. Further, when the end 17 of the strap 15 is tightened, the frames 51 and 52 can be brought together into close aligned relation so as to tightly engage the threaded strap and resist inadvertent loosening thereof.

It will be evident from a description of the embodiment illustrated in FIGS. 6 to 10 that a crossbar 26 may be employed in either of the forms shown and described, the crossbar being placed relatively near the connecting end and away from the free end or leverage end of the outer frame member. In using the crossbar, the overall length of the frame members would be reduced, or the free end of the lower frame member would be broadened or widened so as to reduce the gap for threading of the loop downwardly between the crossbar 26 and the free end of the lower frame.

It is therefore to be understood that various modifications and changes may be made in the specific construction and arrangement of parts comprising the different embodiments of the present invention without departing from the spirit and scope thereof as defined by the appended claims.

I claim:

1. In a strap-retention fastener for chinstraps and the like in which said chinstrap is provided with a first strap portion having a loop end and a second strap portion terminating in a free end to be releasably secured to said loop end, the improvement comprising:

a pair of generally rectangular, inner and outer open frame members having connecting ends secured within said loop end of said one strap portion, said frame members each being of broad flat configuration with an open rectangular space therein, said loop end defining a clearance space for limited longitudinal sliding movement of said inner and outer frame members with respect to each other, said frame members each having opposite sides extending away from a respective connecting end and terminating in an opposite free end portion said outer frame member having further portions extending toward each other from said opposite sides, a crossbar extending between opposite sides of said outer frame member in spaced parallel relation to said connecting end and further portions of said outer frame member, said crossbar extending across said open rectangular space of said outer frame member in closely spaced relation relatively near said connecting end and away from said free end portion, a pair of first and second release tabs flanking opposite sides of said outer frame member and extending beyond said opposite sides of said inner frame member and a third release tab disposed on said free end of said inner frame member and extending beyond said further portions of said outer frame member, said release tabs being exposed for grasping by the thumb and fingers of one hand and for pushing in directions opposite to each other when the free end of said strap is passed through said frame members, doubled over said outer frame member and returned through said inner frame member in securing said strap portions together.

2. In a strap-retention fastener according to claim 1, said free end portion of said outer frame member being recessed to expose the free end portion of said inner frame member.

3. In a strap-retention fastener according to claim 1, said further portions of said outer frame member separated to form a passage therethrough in communication with said open rectangular space.

4. In a strap-retention fastener according to claim 1, one side of said outer frame member being recessed to define an entrance for passage of said doubled over portion of said strap over said crossbar, said crossbar terminating in a free end portion at the recessed side of said outer frame member.

5. In a fastener of the type wherein a pair of inner and outer frame members each have opposite sides extending away from a closed end portion to terminate in an opposite free end portion and are provided with means pivotally connecting said closed end portions together, said free end portions being free to pivot with respect to said closed end portions toward and away from each other so that a strap member can be passed through both frame members, doubled over the free end portion of said outer frame member and returned within the inner frame member whereby tightening of the free end of the strap will cause the frame members to be compressed together against the doubled-over portion of the strap, the improvement comprising:

a pair of first release tab means projecting from opposite sides of said outer frame member in a direction toward said inner frame member, a portion of said first release tab means being located adjacent said free end portion of said outer frame member, said first release tab means defined by thin plate members disposed at right angles to said opposite sides of said outer frame member and extending the greater length of said opposite sides, said plate members being tapered along their length from a widened portion adjacent the free end portion of said outer frame member to a relatively narrow portion adjacent said closed end, whereby compression of said frame members by tightening said strap member is operative to cause said widened portions to move into overlapping relation to the opoosite sides of said inner frame member;

second release tab means projecting forwardly from the free end of said inner frame member and elevated with respect to said opposite sides of said inner frame member so as to facilitate simultaneously pressing said second tab means and first tab means in directions opposite to one another and to apply opposing forces between the inner and outer frame members, thereby operating to pivot said frame members away from each other for release of said strap member; and means defining a clearance space associated with said pivotal connection means adjacent said closed end portions whereby said outer frame member is shiftable in a lengthwise direction with respect to said inner frame member as said frame members are pivoted away from each other for release of said strap member.

6. In a fastener according to claim 5, said second release tab means defined by a forward extension of said free end of said inner frame, said extension including a first bent portion at right angles to said free end and in a direction toward said outer frame member and a second bent portion in an outward directon defining a tab in spaced parallel relation to said inner frame member.

7. In a fastener according to claim 5, said inner and outer frame members defined by flat rigid members of generally rectangular cross-section, and said first and second release tab means being provided with knurled grasping surfaces.

* * * * *